US009938736B2

(12) United States Patent
Stover et al.

(10) Patent No.: US 9,938,736 B2
(45) Date of Patent: Apr. 10, 2018

(54) BARRIER SAFETY GATE

(71) Applicants: Carl L. Stover, Ostrander, OH (US); Craig T. Jones, Johnstown, OH (US); Dennis R. Weber, Delaware, OH (US)

(72) Inventors: Carl L. Stover, Ostrander, OH (US); Craig T. Jones, Johnstown, OH (US); Dennis R. Weber, Delaware, OH (US)

( * ) Notice: Subject to any disclaimer, the term of this patent is extended or adjusted under 35 U.S.C. 154(b) by 43 days.

(21) Appl. No.: 14/873,148

(22) Filed: Oct. 1, 2015

(65) Prior Publication Data

US 2016/0097208 A1 Apr. 7, 2016

Related U.S. Application Data

(60) Provisional application No. 62/058,173, filed on Oct. 1, 2014.

(51) Int. Cl.
*E04G 21/32* (2006.01)
*E06B 11/00* (2006.01)

(52) U.S. Cl.
CPC ..... *E04G 21/3233* (2013.01); *E06B 11/00* (2013.01)

(58) Field of Classification Search
CPC .... E06B 11/022; E06B 11/023; E06B 11/026; E06B 11/045; E06B 11/08; E06B 11/085; A01K 1/0017; A01K 1/0023; A01K 1/0029; A01K 1/0613; A01K 1/062; A01K 1/10; A01K 1/105; A01K 1/04; E04G 21/3223; E04G 5/141
USPC ..... 256/1, 73; 49/35, 117, 116, 360, 192, 49/131, 386
See application file for complete search history.

(56) References Cited

U.S. PATENT DOCUMENTS 3,478,467 A * 11/1969 May ..... G07C 9/02 49/35
3,814,060 A * 6/1974 Swenson ..... A01K 1/062 119/734
4,026,069 A * 5/1977 Bohnett ..... A01K 3/00 119/840
4,150,510 A * 4/1979 Harrison ..... E06B 11/00 49/388
4,947,964 A * 8/1990 Husmann ..... B66B 13/12 187/314
5,974,737 A * 11/1999 Barros ..... E05F 1/025 49/116
6,138,812 A * 10/2000 Kimener ..... E06B 11/00 193/35 G
7,963,069 B2 * 6/2011 Ropelato ..... E05F 15/649 49/140
2015/0040481 A1 * 2/2015 Stover ..... E06B 11/04 49/50

* cited by examiner

*Primary Examiner* — Jonathan P Masinick
(74) *Attorney, Agent, or Firm* — Miracle IP; Bryce D. Miracle

(57) ABSTRACT

A barrier safety gate is provided which flexes and moves apart in order to receive the vertical path of motion of forks of a fork lift for loading and unloading from a raised platform. The barrier safety gate includes a first and a second pair of opening, flexible guidance members having a default, closed position and an opening, flexible path of motion. In particular, each pair of guidance members are laterally aligned to flex apart to receive the width of each respective fork of the fork lift which provides an opening force through their vertical paths of motion.

5 Claims, 4 Drawing Sheets

BARRIER SAFETY GATE

This application is based upon and claims the priority filing date of the previously filed, U.S. Provisional patent application entitled "FLEXIBLE SAFETY GATE" filed Oct. 1, 2015, Ser. No. 62/058,173, the entire disclosure of which is hereby incorporated herein by reference.

BACKGROUND

In industrial applications, mezzanine floor systems are semi-permanent floor systems typically installed within buildings, built between two permanent original stories. These structures are usually free standing and in most cases can be dismantled and relocated. Commercially sold mezzanine structures are generally constructed of steel, aluminum, and fiberglass.

Mezzanines are frequently used in industrial operations such as warehousing, distribution or manufacturing. These facilities have high ceilings, allowing unused space to be utilized within the vertical cube. Industrial mezzanine structures are typically either structural, roll formed, rack-supported, or shelf-supported, allowing high density storage within the mezzanine structure.

Mezzanines are often built without fall protection resulting in frequent accidents including serious injury and even death. Moreover, in order for fork lifts and other machinery to access and deliver and receive goods to and from a mezzanine level, an opening must be present within existing railing and barrier systems. There have been many attempts to try and solve this problem without any reliable, cost effective solution. For example, employees have been required to connect themselves by a cord or other connection means to part of the mezzanine structure, such that if they did fall the cord would prevent them from falling over the side of the mezzanine onto the floor below. However, this requires that the employee painstakingly follow through with connecting and disconnecting throughout each position on the mezzanine. This process of connecting and disconnecting requires substantial time and effort in order to properly follow through.

Other varying gate and rail solutions have been tried without success such as duel interlock roll around gates, barn door style gates, or gates that swing open. However, these types of design are expensive and require more space, thus reducing the available storage. Moreover, electric hand rail systems have been tried, but have been found to be extremely costly and require an operator.

For the foregoing reason, there is a need for a method and apparatus that will provide a cost efficient, yet safe and reliable, easy to remove and operate fall protection for mezzanines and other platforms.

SUMMARY

In accordance with the invention, a barrier safety gate apparatus is provided which couples as a cost efficient and reliable gate for preventing falls and injury as well as a gate that can easily be adapted for use in conjunction with existing equipment such as a fork lift. This provides a safe, low-cost, and time saving apparatus and method for preventing falls and keeping employees safe while on a platform.

The invention generally comprises a flexible gate having a first and second pair of moveable, guidance rails. Each pair of moveable, guidance rails is adapted to receive, move apart, and possibly flex in order to accommodate a greater width of a fork of a forklift—as it passes vertically through a path of motion through the barrier safety gate. In other words, as the forklift forks moves downward encountering the top of the barrier safety gate with each fork, each pair of guidance rails flexes and moves apart from one another in order to provide space for the forklift forks to move downward, thereby providing the ability to effectively deliver a load to the platform behind the barrier safety gate without compromising safety and maximizing efficiency. After the presence of the fork lift forks are removed, the gate will automatically return to the default, close position which provides a barrier that is qualified to meet or exceed OSHA law and regulations per the United States Department of Labor.

In a version of the invention, a barrier safety gate is provided that is operable to flex and move apart in order to receive a vertical movement of forks of a fork lift for loading and unloading from a raised platform, the barrier safety gate comprises (a) first and a second pair of opening, flexible guidance members having a default, closed position and an opening, flexible path of motion, each pair of guidance members are laterally aligned to flex apart to receive a width of each respective fork of the fork lift providing an opening force through their vertical paths of motion; and (b) a support assembly for supporting the first and second pair of guidance members through their respective opening, flexible paths of motion.

In another version, the support assembly comprises a first and second pair of stationary, laterally spaced, upright support members paired with the first and second guidance members respectively, and at least one lateral support member operably connecting each flexible guidance member with the respective upright support member, wherein each lateral support member provides a limited path of lateral movement between the support member and the guidance member, and wherein an elastic compression means is positioned between each guidance rail and each corresponding upright support member for providing a resistive counter force to the application of the opening force produced by the forks through their respective vertical paths of motion and biasing the guidance members in their respective default, closed position.

In yet another version, at least one of the upright support members of the support assembly comprises a rigidly attached guidance pin and the respective lateral support member comprises a lateral slot, wherein the guidance pin is operable to travel along the lateral slot permitting the respective guidance member to move towards and away from the upright support member in a limited lateral path of motion as well as pivot about the guidance pin. Thus, providing flexibility and vertical stability of the guidance member throughout the opening path of motion of the guidance member.

Still other versions, benefits and advantages of the invention will become apparent to those skilled in the art to which it pertains upon a reading and understanding of the following detailed specification.

BRIEF DESCRIPTION OF THE DRAWINGS

These and other features, aspects, and advantages of the present invention will become better understood with regard to the following description and accompanying figures where.

DETAILED DESCRIPTION

Figure 1:
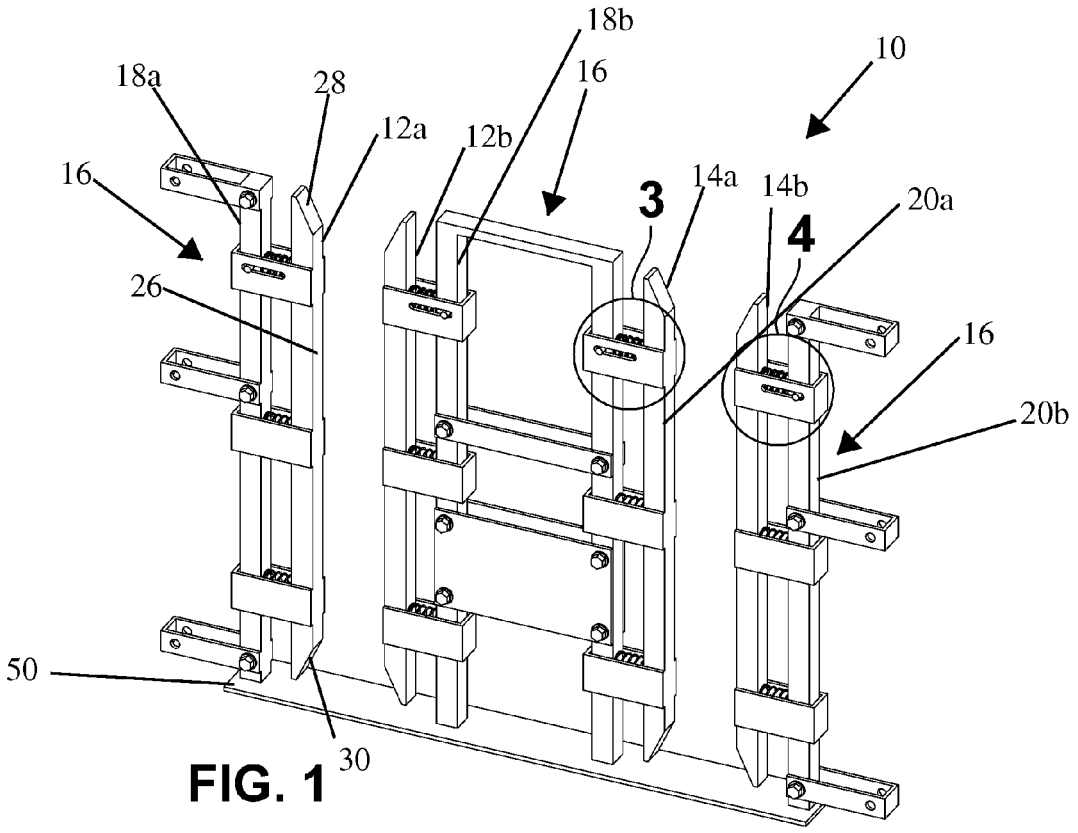
FIG. 1 is a front perspective view of a version of the invention shown in the default, closed position.

Referring now to the figures wherein the showings are for purposes of illustrating a preferred version of the invention only and not for purposes of limiting the same, the present invention is a barrier safety gate configured to move and flex open in order to accommodate and receive the vertical movement and presence of the forks of a fork lift for the delivery of goods to a platform. This provides a safe, ergonomic safety barrier for preventing falls and injury as well as a gate that is minimally and effectively opened by existing fork lift equipment.

The following detailed description is of the best currently contemplated modes of carrying out exemplary versions of the invention. The description is not to be taken in the limiting sense, but is made merely for the purpose illustrating the general principles of the invention, since the scope of the invention is best defined by the appended claims.

Various inventive features are described below that can each be used independently of one another or in combination with other features.

With reference now to the drawings, and in particular to FIG. 1-FIG. 5 thereof, a new barrier safety gate for preventing falls while delivering a load to a platform embodying the principles and concepts of the present invention and generally designated by the reference numeral 10 will be disclosed.

Figure 2:
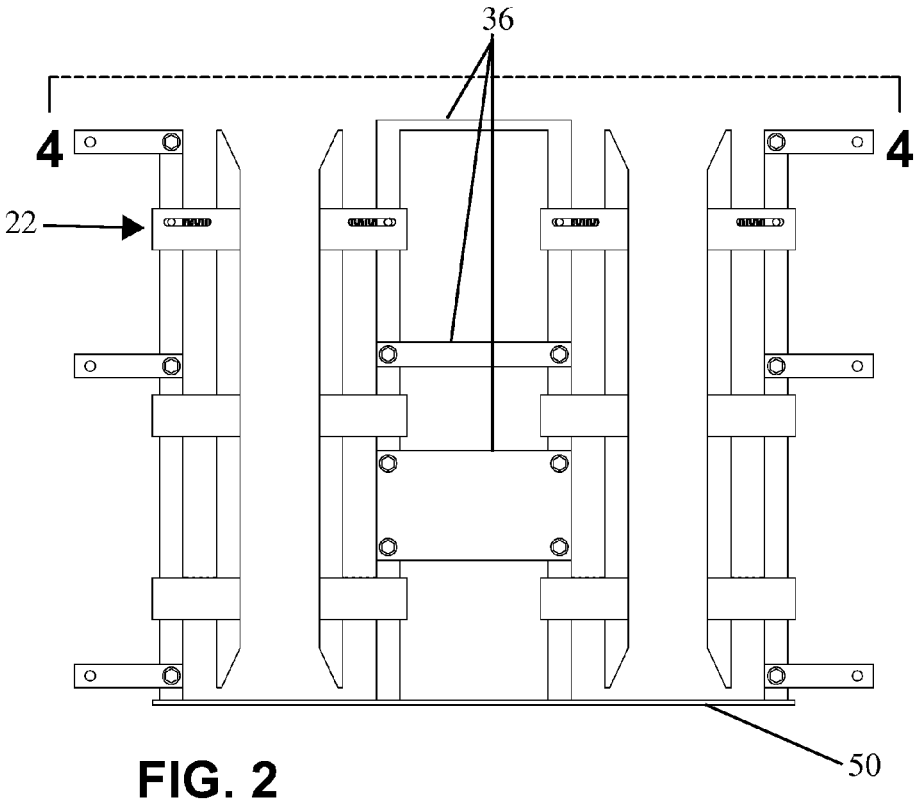
FIG. 2 is a front elevation view of the version shown in FIG. 1 in the default, closed position.

As best illustrated by FIG. 1 and FIG. 2, the barrier safety gate 10 generally comprises a first and second pair of opening, flexible guidance members or rails 12, 14 which have a default, closed position (depicted by FIG. 1-FIG. 5) and an opening, flexible path of motion (depicted by FIG. 6-FIG. 9); and a support assembly generally depicted by reference numeral 16 for supporting the first and second pair of guidance rails 12, 14 through their respective opening paths of motion.

In the version, the first and second pairs of guidance members 12, 14 are two pairs of elongated, laterally aligned rails 12*a*, 12*b*, 14*a*, 14*b* generally positioned in vertical parallel with each other. The first and second pairs of guidance rails 12, 14, within each pair, mirror one another within the pair, with each having an inner contact surface 26 facing the other.

In the illustrated version, each guidance rail 12*a*, 12*b*, 14*a*, 14*b* may have angled top 28 and bottom surfaces 30, with each angled surface facing inwardly central of each pair of the first and second guidance rails 12, 14. Thus, initially, the angled top 28 and bottom surfaces 30 assist in effectively engaging the forks as they travel through their respective vertical paths of motion through the barrier safety gate 10.

The support assembly 16 generally provides a rigid, stationary structure which in combination with the first and second pairs of guidance rails 12, 14 in their default, closed position form a barrier for preventing falls. The barrier safety gate 10 is typically rigidly attached via the support assembly 16 at a delivery point within a safety railing system located at the perimeter of a mezzanine structure or other raised platform. The barrier safety gate 10 can be utilized in conjunction any type of safety railing configuration and delivery point accessing the raised platform.

In the version and as illustrated, the support assembly 16 comprises a first and second pair of stationary, laterally spaced, upright support members 18, 20. The first pair of guidance rails 12 are laterally positioned, primarily in parallel, between the first pair of upright support members 18 and the second pair of guidance rails 14 are positioned similarly between the second pair of upright support members 20. It will be known that the inner two upright support members 18*b*, 20*a* may be one in the same and are generally connected together by one or more rigid connection members 36.

Figure 3:
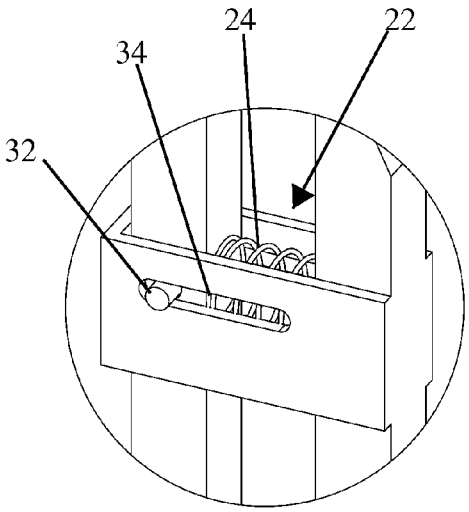
FIG. 3 is an up-close view of the lateral support member taken from FIG. 1.
Figure 4:
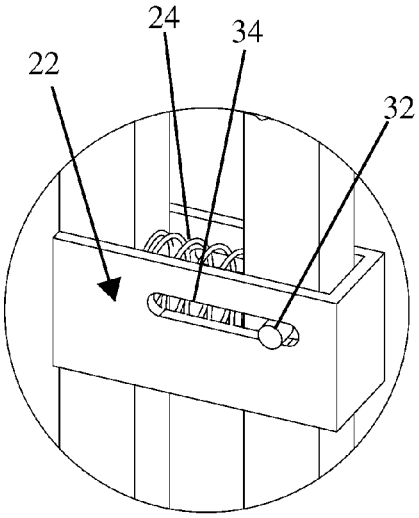
FIG. 4 is an up-close view of an adjacent lateral support member taken from FIG. 1.
Figure 5:
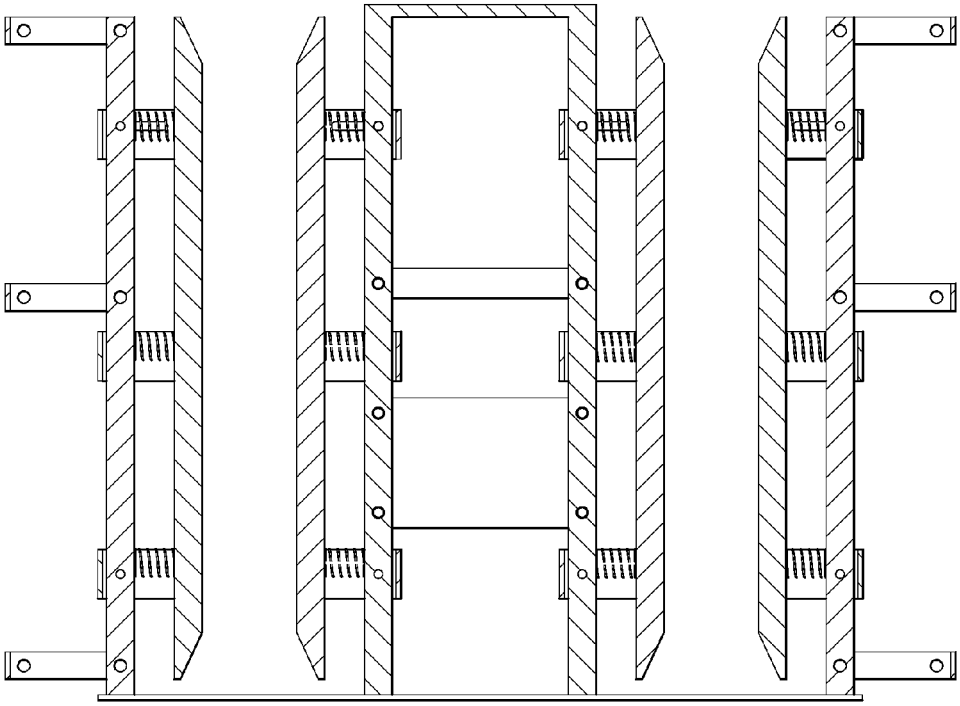
FIG. 5 is a sectional view of the version shown in FIG. 2 taken along lines 4-4.

In the version and best shown FIG. 1, FIG. 3 and FIG. 4, each guidance rails 12*a*, 12*b*, 14*a*, 14*b* are flexibly attached to their respective upright support member 18*a*, 18*b*, 20*a*, 20*b* by at least one lateral support member 22. The lateral support member 22 is rigidly attached to the respective guidance rail 12*a* and operably attached to the corresponding upright support member 18*a* which provides a limited path of lateral movement between the support member 18*a* and the guidance rail 12*a*. In the specific illustrated version, multiple support members 22 are utilized in combination to support and provide lateral movement of the first and second pair of guidance members 12, 14 through their respective opening, flexible paths of motion. It will be known that other configurations may be utilized to carry out the aforementioned supporting functionality.

In the particular version, the lateral support member 22 is an open rectangular encasement configuration which rigidly attaches to the guidance 12*a* member and freely embraces the respective upright support member providing a limited path of motion between the support member 18*a* and the guidance rail 12*a*. Other configurations of the lateral support member 22 may be contemplated which carry out the same objective of providing a structure that allows the first and second pairs of guidance rails 12, 14 to move and flex apart during operation.

Moreover, at least one elastic compression means 24 is operably positioned between each guidance rail 12*a*, 12*b*, 14*a*, 14*b* and each corresponding upright support member 18*a*, 18*b*, 20*a*, 20*b* for providing a resistive counter force to the application of the opening force produced by the forks through their respective vertical paths of motion and simultaneously biasing the guidance rails 12*a*, 12*b*, 14*a*, 14*b* in their respective default, closed position. Thus, during the vertical path of motion of the forks of the forklift, the first and second pair of guidance rails 12, 14 move and flex apart to accommodate the width of each respective fork as the forks move through a vertical path of motion, and when the forks are removed, the barrier safety gate 10 will revert to the default, closed position. The elastic compression means 24 can be one or more conical compression springs 24. In the illustrated version, there are three conical compression springs 24 operably inserted between each upright support member 18*a*, 18*b*, 20*a*, 20*b* and respective guidance rail 12*a*, 12*b*, 14*a*, 14*b* held in place by fasteners.

In the illustrated version as best shown in FIG. 3 and FIG. 4, the upper most lateral support members 22 of each pair comprise a lateral slot 34 which is coupled with a corresponding guidance pin 32. The guidance pin 32 is rigidly connected to the respective upright support member 18*a*, 18*b*, 20*a*, 20*b*, wherein the guidance pin 32 is adapted to travel along the lateral slot 34 permitting the corresponding guidance rail 12*a*, 12*b*, 14*a*, 14*b* to move towards and away from the upright support member 18*a*, 18*b*, 20*a*, 20*b* in a limited lateral path of motion as well as pivot about the guidance pin 32. Thereby providing flexibility and vertical stability of the guidance rail 12*a*, 12*b*, 14*a*, 14*b* throughout its opening path of motion. Preferably, the guidance pin 32 is a fixed bolt. The fixed bolt 32 connects the upright support member 18*a*, 18*b*, 20*a*, 20*b* to the lateral support member 22 by passing through both the upright support member 18*a*, 18*b*, 20*a*, 20*b* and a front and rear pair of aligned lateral slots 34. It will be known, that select lateral support members 22 may optionally utilize the guidance pin and slot configuration to create differing opening, flexible paths of motion of the first and second pair of guidance rails 12, 14.

The flexible safety gate 10 is a solid framed gate preferably made of steel or other form of metal. The flexible safety gate 10 is constructed in a manner that is sturdy and safe to lean on and provides a barrier while in the default, closed position that meets or exceeds OSHA safety gate requirements. While in the default, closed position, the resistive force provided by the one or more springs 24 is sufficient to meet or exceed hand rail standards, thus providing a safe, sturdy and reliable barrier which people can lean on and push down on without the gate moving.

Now referring to FIG. 1, FIG. 6-FIG. 9, the method and operation of the version will be described in detail.

FIG. 1 shows the barrier safety gate 10 in the default, closed position. The barrier safety gate 10 in this position is strong and sturdy providing a minimum distance within each pair of guidance rails 12, 14 meeting OSHA guidelines preventing falls and serious injury.

Figure 6:
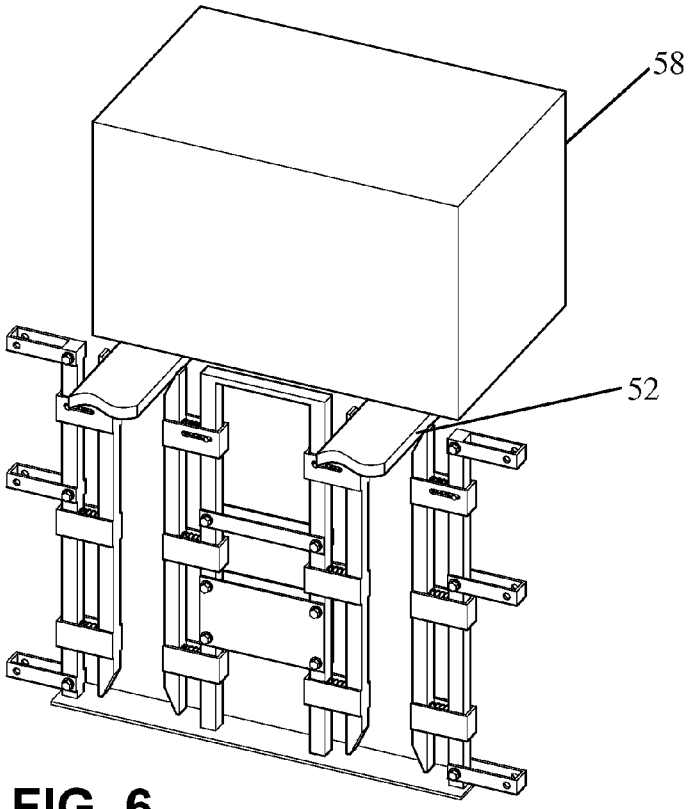
FIG. 6 is an illustrative front perspective view of the version shown in FIG. 1 showing the forks of a fork lift approaching the top of the barrier safety gate.

FIG. 6 shows the forks 52 of a fork lift applying a downward force to the angled top and bottom surfaces 28, 30 of the first and second pair of guidance rails 12, 14. Thereby, effectively engaging and initiating the opening and flexing of the barrier safety gate 10.

Figure 7:
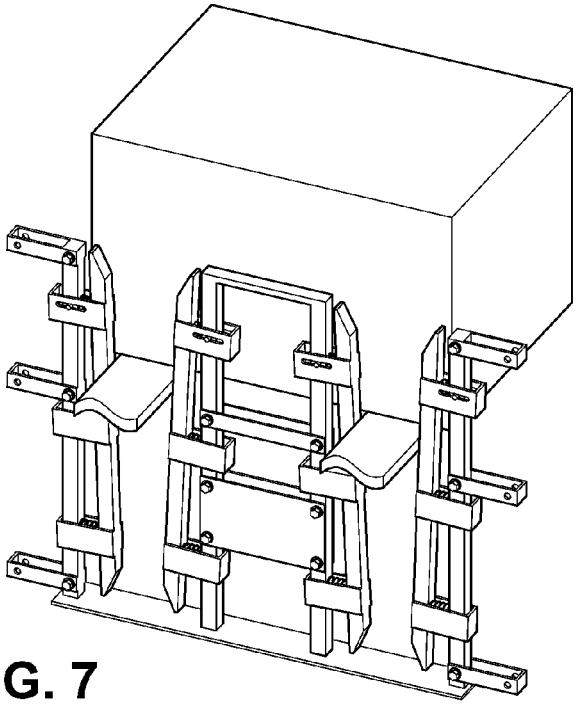
FIG. 7 is an illustrative front perspective view of the version shown in FIG. 1 showing the fork lift moving downward through its vertical path of motion, opening and flexing the barrier safety gate.

FIG. 7 shows the forks 52 moving downward through a path of motion simultaneously moving and flexing the first and second pairs of guidance rails 12, 14.

Figure 8:
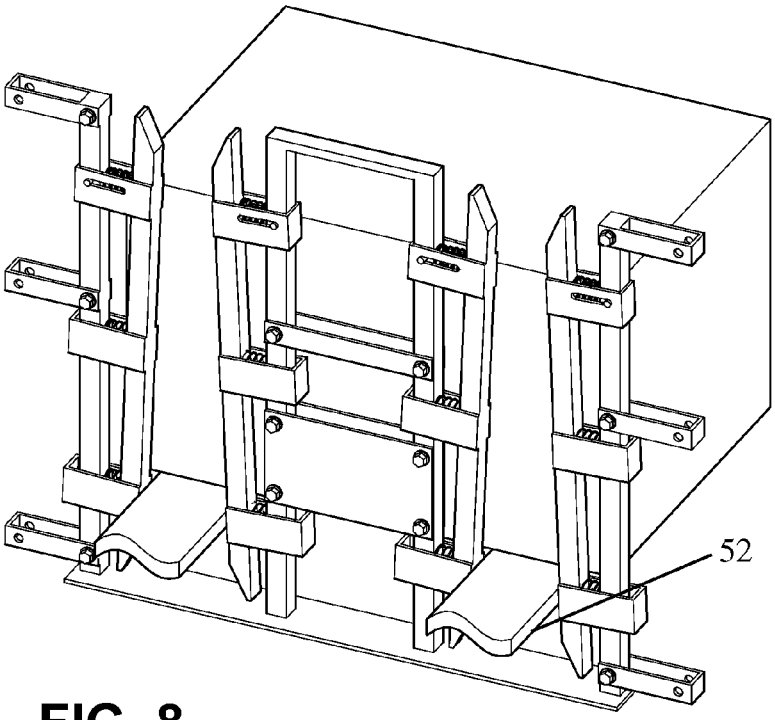
FIG. 8 is an illustrative front perspective view of the version shown in FIG. 1 showing the fork lift moving downward through its vertical path of motion towards the bottom of the gate.

FIG. 8 shows the forks 52 moving down through a path of motion approaching the bottom of the barrier safety gate 10 continuing to move and flex the first and second pairs of guidance rails 12, 14.

Figure 9:
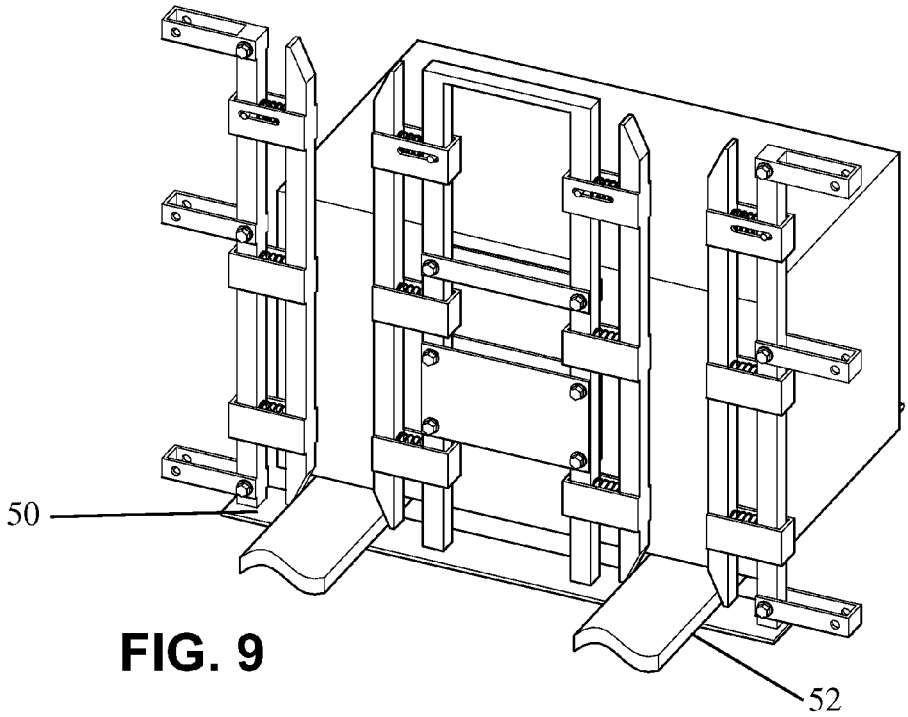
FIG. 9 is an illustrative front perspective view of the version shown in FIG. 1 showing the forks completing travel through the barrier safety gate positioned at the bottom of the barrier safety gate.

FIG. 9 shows the forks 52 at the lowest point of the path of motion at the platform 50 surface where the load 58 can be removed from the forks 52 safely behind the barrier safety gate. The forks 52 can then return by ascending back through the barrier safety gate 10 or by horizontally removing them from the bottom of the thereof.

The present invention can be made in any manner and of any material chosen with sound engineering judgment. Preferably, materials will be strong, lightweight, long lasting, economic, and ergonomic.

The invention does not require that all the advantageous features and all the advantages need to be incorporated into every version of the invention.

Although preferred versions of the invention have been described in considerable detail, other versions of the invention are possible.

All the features disclosed in this specification (including and accompanying claims, abstract, and drawings) may be replaced by alternative features serving the same, equivalent or similar purpose unless expressly stated otherwise. Thus, unless stated otherwise, each feature disclosed is one example only of a generic series of equivalent or similar features.

What is claimed is:

1. A barrier safety gate operable to flex and move apart in order to receive a vertical movement of forks of a fork lift for loading and unloading from a raised platform, comprising:

(a) a first pair and a second pair of opening, flexible guidance rails, the first pair and the second pair of guidance rails are laterally positioned for receipt and vertical passage of each respective fork, each pair of guidance rails having a default, closed position and an opening, flexible path of motion, wherein each pair of guidance rails are laterally aligned to flex apart to receive and have constant contact with each respective fork of the fork lift providing an opening force throughout their respective vertical paths of motion; and (b) a support assembly for supporting the first and second pair of guidance rails through their respective opening paths of motion, the support assembly comprising:

i) a first pair and second pair of stationary, laterally spaced, upright support members;

ii) at least one lateral support member operably connecting each guidance rail with their respective upright support member, wherein the lateral support member is a rigid structure which is statically connected to the respective guidance rail and configured to be movable to and freely embrace the respective upright support member providing a limited path of lateral movement between the support member and the guidance rail; and iii) at least one spring operably positioned between each guidance rail and each corresponding support member for providing a resistive counter force to the application of the opening force produced by the forks through their respective vertical paths of motion and biasing the guidance rails in their respective default, closed position, whereby during the vertical movement of the forks of the forklift, the first and second pair of guidance rails move and flex apart to accommodate the width of each fork as the forks move through a vertical path of motion, and when the forks are removed, the barrier safety gate will revert to the default, closed position.

2. The barrier safety gate of claim 1, wherein at least one of the upright support members comprises a rigidly attached guidance pin and the respective lateral support member comprises a lateral slot, wherein the guidance pin is adapted to travel along the lateral slot permitting the corresponding guidance rail to move towards and away from the upright support member in a limited lateral path of motion as well as pivot about the guidance pin, whereby providing flexibility and vertical stability of the guidance rail throughout the opening path of motion of the guidance member.

3. The barrier safety gate of claim 2, wherein the first and second pair of guidance rails further comprise angled top surfaces and an angled bottom surfaces, each angled surface facing inwardly central of each pair of the first and second pair of guidance rails, whereby, initially, the angled top and bottom surfaces assist in smoothly engaging the forks as they travel through their respective vertical paths of motion through the barrier safety gate.

4. A barrier safety gate operable to flex and move apart in order to receive a vertical movement of forks of a fork lift for loading and unloading from a raised platform, comprising:

(a) a first pair and a second pair of opening, flexible guidance rails, the first pair and the second pair of guidance rails are laterally positioned for receipt and vertical passage of each respective fork, each pair of guidance rails having a default, closed position and an opening, flexible path of motion, wherein each pair of guidance rails are laterally aligned to flex apart to receive and have constant contact with each respective fork of the fork lift providing an opening force throughout their respective vertical paths of motion;

(b) a support assembly for supporting the first and second pair of opening guidance rails through their respective opening paths of motion, the support assembly comprising:

i) a first and second pair of stationary, laterally spaced, upright support members paired with the first and second guidance rails respectively; and ii) at least one lateral support member operably connecting each respective flexible guidance rail with the corresponding upright support member, wherein the lateral support member is a rigid structure which is statically connected to the respective guidance rail and configured to be movable to and freely embrace the respective upright support member providing a limited path of lateral movement between the support member and the guidance rail;

iii) at least one spring operably positioned between each guidance rail and each corresponding support member for providing a resistive counter force to the application of the opening force produced by the forks through their respective vertical paths of motion and biasing the guidance rails in their respective default, closed position; and iv) wherein at least one of the upright support members comprises a guidance pin and the corresponding lateral support member comprises a lateral slot, wherein the guidance pin is adapted to travel along the lateral slot permitting the corresponding guidance rail to move towards and away from the upright support member in a limited lateral path of motion as well as pivot about the guidance pin, whereby providing flexibility and vertical stability of the guidance rail throughout the opening path of motion of the guidance rail.

5. The barrier safety gate of claim 4, wherein the first and second pair of guidance rails further comprise angled top surfaces and an angled bottom surfaces, each angled surface facing inwardly central of each pair of the first and second pair of guidance rails, whereby, initially, the angled top and bottom surfaces assist in smoothly engaging the forks as they travel through their respective vertical paths of motion through the barrier safety gate.

* * * * *